US006223725B1

(12) United States Patent
Onishi et al.

(10) Patent No.: US 6,223,725 B1
(45) Date of Patent: May 1, 2001

(54) HIGH-PRESSURE FUEL SUPPLY ASSEMBLY

(75) Inventors: Yoshihiko Onishi; Shigenobu Tochiyama, both of Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/481,974

(22) Filed: Jan. 13, 2000

(30) Foreign Application Priority Data

Aug. 11, 1999 (JP) ..... 11-227406

(51) Int. Cl.[7] ..... F02M 37/04

(52) U.S. Cl. ..... 123/447; 123/467; 123/514; 123/458; 417/540

(58) Field of Search ..... 417/540; 123/495, 123/467, 447, 458, 514, 446

(56) References Cited

U.S. PATENT DOCUMENTS 4,385,609 * 5/1983 Kato ..... 123/446
4,667,638 * 5/1987 Igashira ..... 123/446
4,884,545 * 12/1989 Mathis ..... 123/447
5,832,904 * 11/1998 Morishita ..... 123/514
6,102,010 * 8/2000 Isozumi et al. ..... 123/446
6,119,655 * 9/2000 Heinitz et al. ..... 123/447
6,131,549 * 10/2000 Onishi ..... 123/495

FOREIGN PATENT DOCUMENTS 11-62772 3/1999 (JP) ..... F02M/55/02

* cited by examiner

*Primary Examiner*—Thomas N. Moulis
(74) *Attorney, Agent, or Firm*—Sughrue, Mion, Zinn, Macpeak & Seas, PLLC

(57) ABSTRACT

A high-pressure fuel supply assembly includes a high-pressure fuel pump for pressurizing fuel from a low-pressure fuel intake passage and discharging high-pressure fuel into a high-pressure fuel discharge passage, a high-pressure damper disposed in the high-pressure fuel discharge passage for absorbing surges in the high-pressure fuel, a high-pressure regulator disposed in a branch passage branching from a branch portion of the high-pressure fuel discharge passage for adjusting the high-pressure fuel from the high-pressure damper to a predetermined pressure, and an orifice disposed in the high-pressure fuel discharge passage downstream from the branch portion for absorbing surges in the high-pressure fuel.

4 Claims, 8 Drawing Sheets

HIGH-PRESSURE FUEL SUPPLY ASSEMBLY

BACKGROUND OF THE INVENTION

1. Field of the Invention

The present invention relates to a high-pressure fuel supply assembly used in a cylinder-injected engine, for example.

2. Description of the Related Art

FIG. 6 is a block diagram showing a construction of a conventional high-pressure fuel supply assembly 100, and FIG. 7 is a partially cut away general cross section of the high-pressure fuel supply assembly 100.

This high-pressure fuel supply assembly 100 includes:

- a low-pressure regulator for pressurizing low-pressure fuel to a predetermined pressure, the low-pressure regulator being disposed in a low-pressure fuel intake passage 3 through which flows low-pressure fuel conveyed by a low-pressure fuel pump 2 within a fuel tank 1;
- a low-pressure damper 5 for absorbing surges in the low-pressure fuel, the low-pressure damper 5 being disposed in the low-pressure fuel intake passage 3;
- a high-pressure fuel pump 6 for pressurizing low-pressure fuel from the low-pressure damper 5 and discharging it into a high-pressure fuel discharge passage 7;
- a high-pressure damper 8 for absorbing surges in the high-pressure fuel flowing through the high-pressure fuel discharge passage 7;
- a high-pressure regulator 10 for adjusting high-pressure fuel to a predetermined pressure, the high-pressure regulator 10 being disposed in a branch passage 9 branching from the high-pressure fuel discharge passage 7 at a branch portion 18; and
- an orifice 11 disposed in the high-pressure fuel discharge passage 7 between the high-pressure damper 8 and the branch portion 18. Moreover, 12 are filters, and 17 is a drainage pipe connecting the high-pressure regulator 10 to the fuel tank 1.

The above high-pressure fuel pump 6 includes: a valve assembly 20 for opening and closing the low-pressure fuel intake passage 3 and the high-pressure fuel discharge passage 7; and a high-pressure fuel supply body 21 for pressurizing low-pressure fuel from the low-pressure fuel intake passage 3 and discharging it into the high-pressure fuel discharge passage 7.

FIG. 8 is a cross section of the valve assembly 20, the valve assembly 20 including: a first plate 22; a second plate 23; and a thin, flat valve main body 19 positioned between the first and second plates 22 and 23. A first fuel inlet 24 connected to the low-pressure fuel intake passage 3 and a first fuel outlet 25 connected to the high-pressure fuel discharge passage 7 are formed in the first plate 22, the inside dimensions of the first fuel outlet 25 being larger than the inside dimensions of the first fuel inlet 24. A second fuel inlet 26 having inside dimensions larger than those of the first fuel inlet 24 and a second fuel outlet 27 having inside dimensions smaller than those of the first fuel outlet 25 are formed in the second plate 23. The valve main body 19 is provided with: an intake-side tongue 28 interposed between the first fuel inlet 24 and the second fuel inlet 26; and a discharge-side tongue 29 interposed between the first fuel outlet 25 and the second fuel outlet 27.

The high-pressure fuel supply body 21 includes:

- a casing 30 housing the valve assembly 20 inside a first recess 30*a;*

- a cylindrical sleeve 31 housed in surface contact with the second plate 23 of the valve assembly 20;
- a piston 33 slidably inserted inside the sleeve 31 forming a fuel pressurization chamber 32 in cooperation with the sleeve 31; and
- a first spring 36 disposed between a recessed bottom surface 34 of the piston 33 and a holder 35, the spring 36 applying force to the piston 33 in a direction which expands the volume of the fuel pressurization chamber 32.

The high-pressure fuel supply body 21 also includes:

- a housing 37 fitted over the sleeve 31;
- a ring-shaped securing member 38 securing the valve assembly 20, the sleeve 31, and the housing 37 inside the first recess 30*a* of the casing 30 by fitting over the housing 37 and engaging the first recess 30*a* of the casing 30 by means of a male thread portion formed on an outer circumferential surface of the securing member 38;
- a metal bellows 40 disposed between the housing 37 and a receiving portion 39;
- a second spring 41 compressed and disposed around the outside of the bellows 40 between the housing 37 and a holder 42; and
- a bracket 43 disposed to surround the second spring 41, the bracket 43 being secured to the casing 30 by a bolt (not shown).

The high-pressure fuel supply body 21 also includes:

- a tappet 44 slidably disposed in a slide bore 43*a* in an end portion of the bracket 43;
- a pin 45 rotatably suspended to follow the shape of a cam (not shown) as a cam shaft rotates and to reciprocate the piston 33; and
- a bush 46 and a cam roller 47 each rotatably fitted onto the pin 45.

The above high-pressure damper 8 is screwed into a second recess 30*b* in the casing 30. The high-pressure damper 8 includes:

- a first case 50;
- a second case 51 disposed opposite the first case 50, the second case 51 forming a space in cooperation with the first case 50; and
- a thin, flat disk-shaped stainless steel diaphragm 54 dividing the space into a back-pressure chamber 52 charged with high-pressure gas and a buffer chamber 53. The diaphragm 54 moves so that the pressure of the fuel flowing into the buffer chamber 53 from the high-pressure fuel discharge passage 7 is equalized with the pressure of the high-pressure gas in the back-pressure chamber 52, thereby changing the volume inside the buffer chamber and absorbing surges in the fuel in the high-pressure fuel discharge passage 7.

In a high-pressure fuel supply assembly 100 having the above construction, the piston 33 is reciprocated by the rotation of the cam secured to the cam shaft of an engine (not shown) by means of the cam roller 47, the bush 46, the pin 45, and the tappet 44.

When the piston 33 is descending (during the fuel intake stroke), the volume of the inside of the fuel pressurization chamber 32 increases and the pressure inside the fuel pressurization chamber 32 decreases. When the pressure inside the fuel pressurization chamber 32 falls below the pressure at the first fuel inlet 24, the intake-side tongue 28 of the valve main body 19 bends towards the second fuel inlet 26, allowing fuel in the low-pressure fuel supply passage 3 to flow through the first fuel inlet 24 into the fuel pressurization chamber 32.

When the piston 33 is ascending (during the fuel discharge stroke), the pressure inside the fuel pressurization chamber 32 increases, and when the pressure inside the fuel pressurization chamber 32 rises above the pressure at the first fuel outlet 25, the discharge-side tongue 29 of the valve main body 19 bends towards the first fuel outlet 25, allowing fuel in the fuel pressurization chamber 32 to flow through the first fuel outlet 25 and the high-pressure fuel discharge passage 7 into the high-pressure damper 8, where fuel pressure surges are absorbed. Fuel pressure surges in the high-pressure fuel are additionally absorbed by the orifice 11 which is disposed downstream from the high-pressure damper 8. After surges have been removed, the high-pressure fuel is supplied to a delivery pipe 13 via a fuel discharge port 15 and a high-pressure pipe 16 formed in an end portion of the high-pressure fuel discharge passage 7, and thereafter supplied to each of the cylinders (not shown) of the engine via the fuel injection valves 14.

In a high-pressure fuel supply assembly 100 of the above construction, the high-pressure damper 8 and the orifice 11 are provided to stabilize the amount of fuel injected by the fuel injection valves 14 and to prevent amplification of surges due to resonation of the delivery pipe 13 which results from fuel pressure surges in the high-pressure fuel discharged from the high-pressure fuel pump 6.

FIG. 9 shows data obtained experimentally by the present inventors for the average pressure in the high-pressure fuel supply assembly 100 for orifices 11 of different sizes. It can be seen that the pressure in the high-pressure fuel supply assembly 100 is higher than when there is no orifice 11 and that the pressure in the high-pressure fuel supply assembly 100 increases as the diameter of the bore in the orifice 11 is reduced.

Furthermore, FIG. 10 shows the surge pressure (the difference between high and low pressure) in the delivery pipe 13. It can be seen that the surge pressure in the delivery pipe 13 is smaller than when there is no orifice 11 and that the surge pressure in the delivery pipe 13 is further reduced as the diameter of the bore the orifice 11 is reduced.

In a high-pressure fuel supply assembly 100 of the above construction, the orifice 11 is disposed upstream from the high-pressure regulator 10 and as shown in FIG. 9, when the flow discharged from the high-pressure fuel pump 6 is increased in the high rotational frequency region of the engine, the loss of pressure in the orifice 11 increases, and since the high-pressure regulator 10 adjusts the pressure in the delivery pipe to a predetermined level, the fluid pressure from the fuel pressurization chamber 32 to just upstream of the orifice 11 is raised proportionately to this loss in pressure. For that reason, one problem has been that excessive loads are placed on the high-pressure fuel pump 6, the high-pressure damper 8, and the cam shaft which drives the high-pressure fuel pump 6, reducing the working life of the high-pressure damper 8 and the cam shaft.

Another problem has been that the range of the working pressure of the high-pressure damper 8 has had to be enlarged.

Furthermore, when the diameter of the orifice 11 is reduced in order to reduce surge pressure in the delivery pipe 13 further, the loss of pressure at the orifice 11 increases proportionately, raising the fuel pressure in the fuel pressurization chamber 32, and another problem has been that when the fuel pressure rises too high, the flow discharged from the high-pressure fuel pump 6 is reduced. This problem has been particularly evident in the high rotational frequency region where the flow discharged from the high-pressure fuel pump 6 is increased.

SUMMARY OF THE INVENTION

The present invention aims to solve the above problems and an object of the present invention is to provide a high-pressure fuel supply assembly with improved working life, enabling surges in a delivery pipe to be reduced without raising fuel pressure in a fuel pressurization chamber or a high-pressure damper of a high-pressure fuel pump.

To this end, according to the present invention, there is provided a high-pressure fuel supply assembly comprising: a high-pressure fuel pump for pressurizing fuel from a low-pressure fuel intake passage and discharging it into a high-pressure fuel discharge passage; a high-pressure damper for absorbing surges in the high-pressure fuel, the high-pressure damper being disposed in the high-pressure fuel discharge passage downstream from the high-pressure fuel pump; a high-pressure regulator for adjusting high-pressure fuel from the high-pressure damper to a predetermined pressure, the high-pressure regulator being disposed in a branch passage branching from a branch portion of the high-pressure fuel discharge passage downstream from the high-pressure damper; and a throttle body for absorbing surges in the high-pressure fuel, the throttle body being disposed in the high-pressure fuel discharge passage downstream from the branch portion.

According to another aspect of the present invention, there is provided a high-pressure fuel supply assembly comprising: a high-pressure fuel pump for pressurizing fuel from a low-pressure fuel intake passage and discharging it into a high-pressure fuel discharge passage; a high-pressure damper for absorbing surges in the high-pressure fuel, the high-pressure damper being disposed in the high-pressure fuel discharge passage downstream from the high-pressure fuel pump; a high-pressure regulator for adjusting high-pressure fuel from the high-pressure damper to a predetermined pressure, the high-pressure regulator being disposed in a branch passage branching from a branch portion of the high-pressure fuel discharge passage downstream from the high-pressure damper; a high-pressure pipe having a first end portion connected to the high-pressure fuel discharge passage and a second end portion connected to a delivery pipe mounted with fuel injection valves; and a throttle body for absorbing surges in the high-pressure fuel from the high-pressure fuel discharge passage, the throttle body being disposed in the high-pressure pipe.

DETAILED DESCRIPTION OF THE PREFERRED EMBODIMENTS

Figure 6:
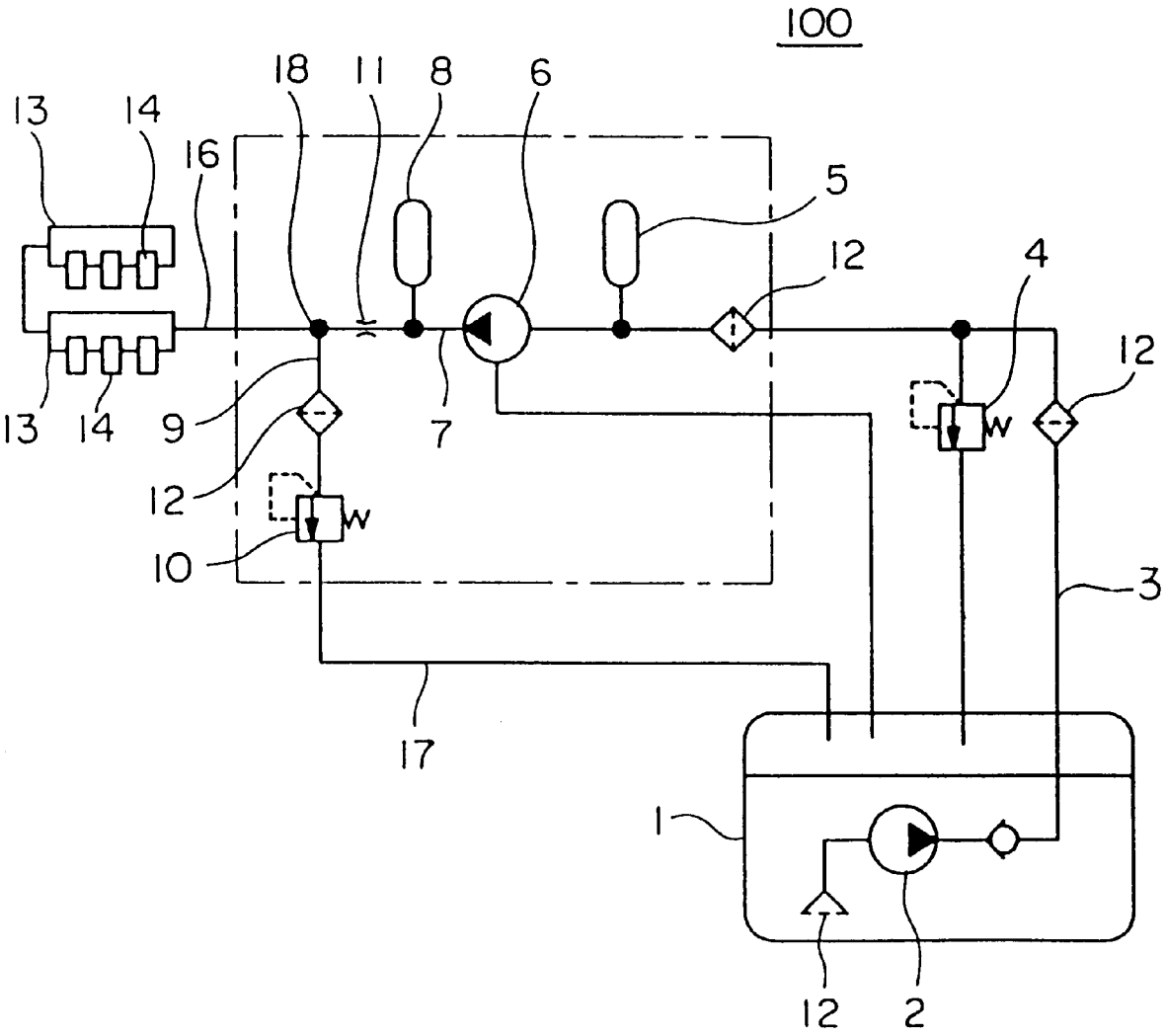
FIG. 6 is a block diagram showing a construction of a conventional high-pressure fuel supply assembly.
Figure 7:
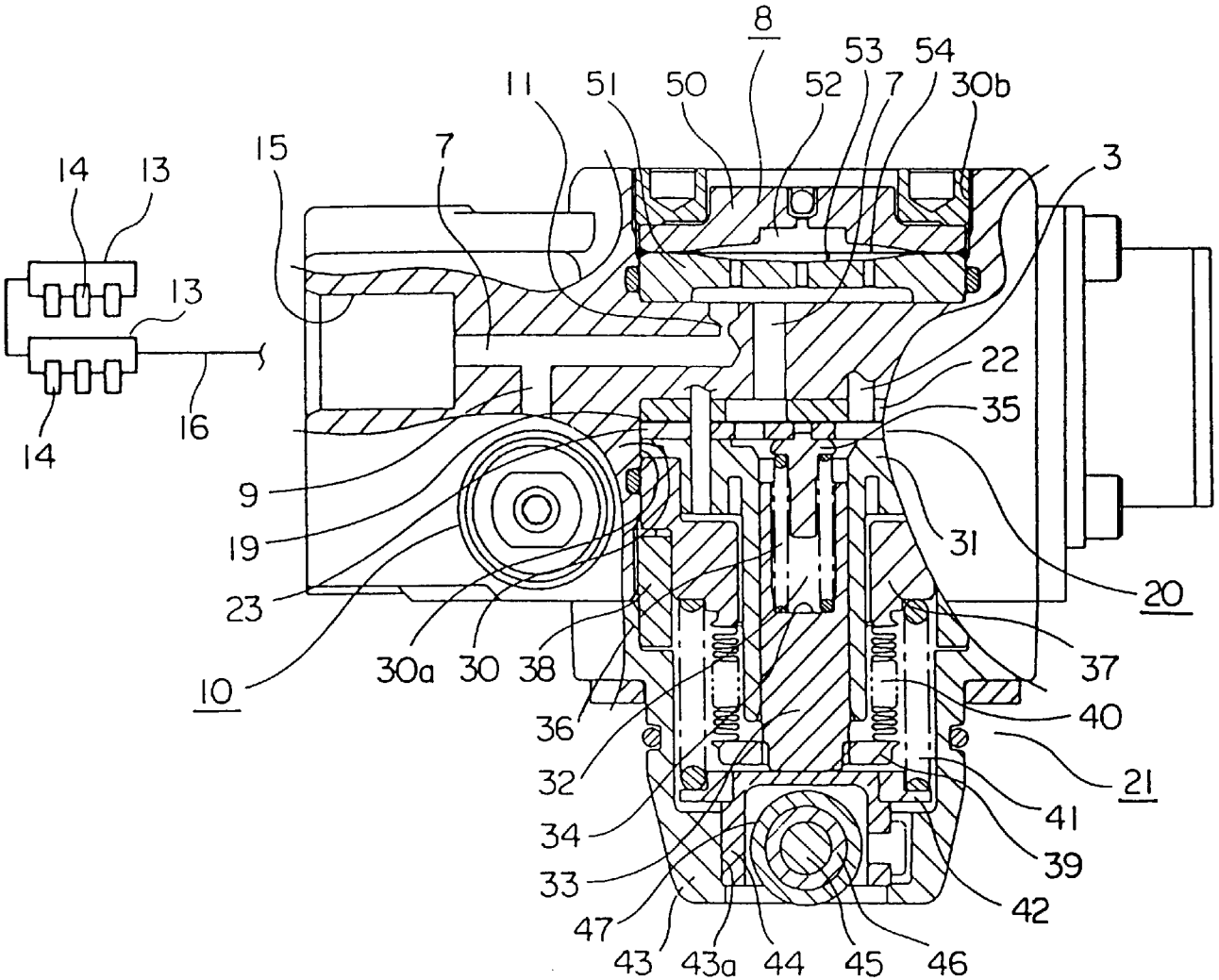
FIG. 7 is a partially cut away general cross section of the high-pressure fuel supply assembly in FIG. 6.
Figure 8:
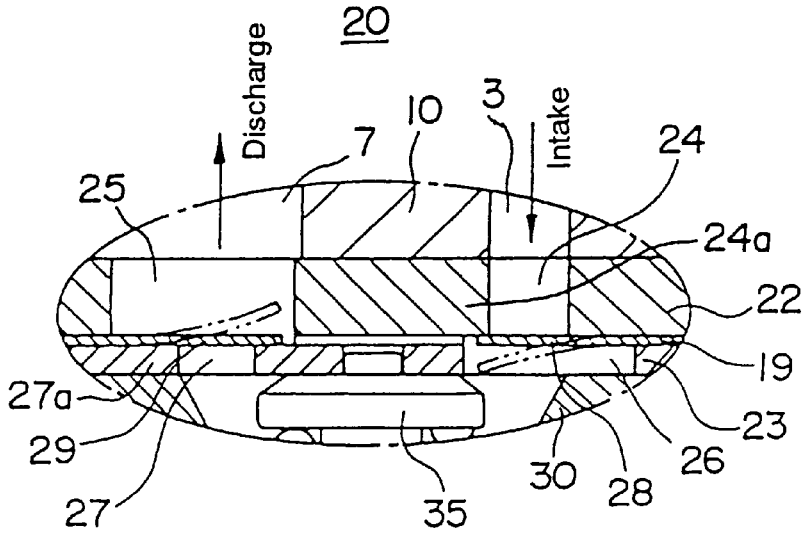
FIG. 8 is a cross section of the valve assembly of the high-pressure fuel pump in FIG. 6.
Figure 9:
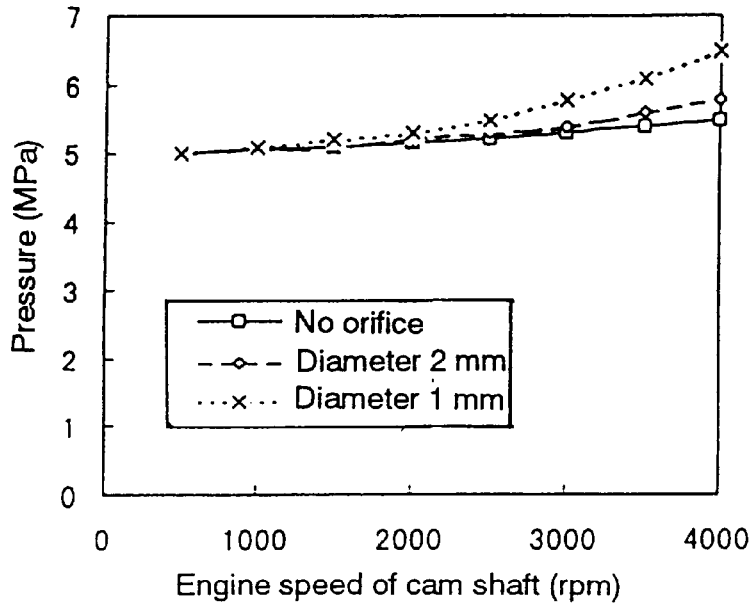
FIG. 9 is a graph of the relationship between the rotational frequency of the cam shaft and internal pressure in the high-pressure fuel supply assembly in FIG.6.

A high-pressure fuel supply assembly 200 according to the present invention will be explained below. Parts the same as or corresponding to those in FIGS. 6 to 8 above will be given the same numbering.

Embodiment 1

Figure 1:
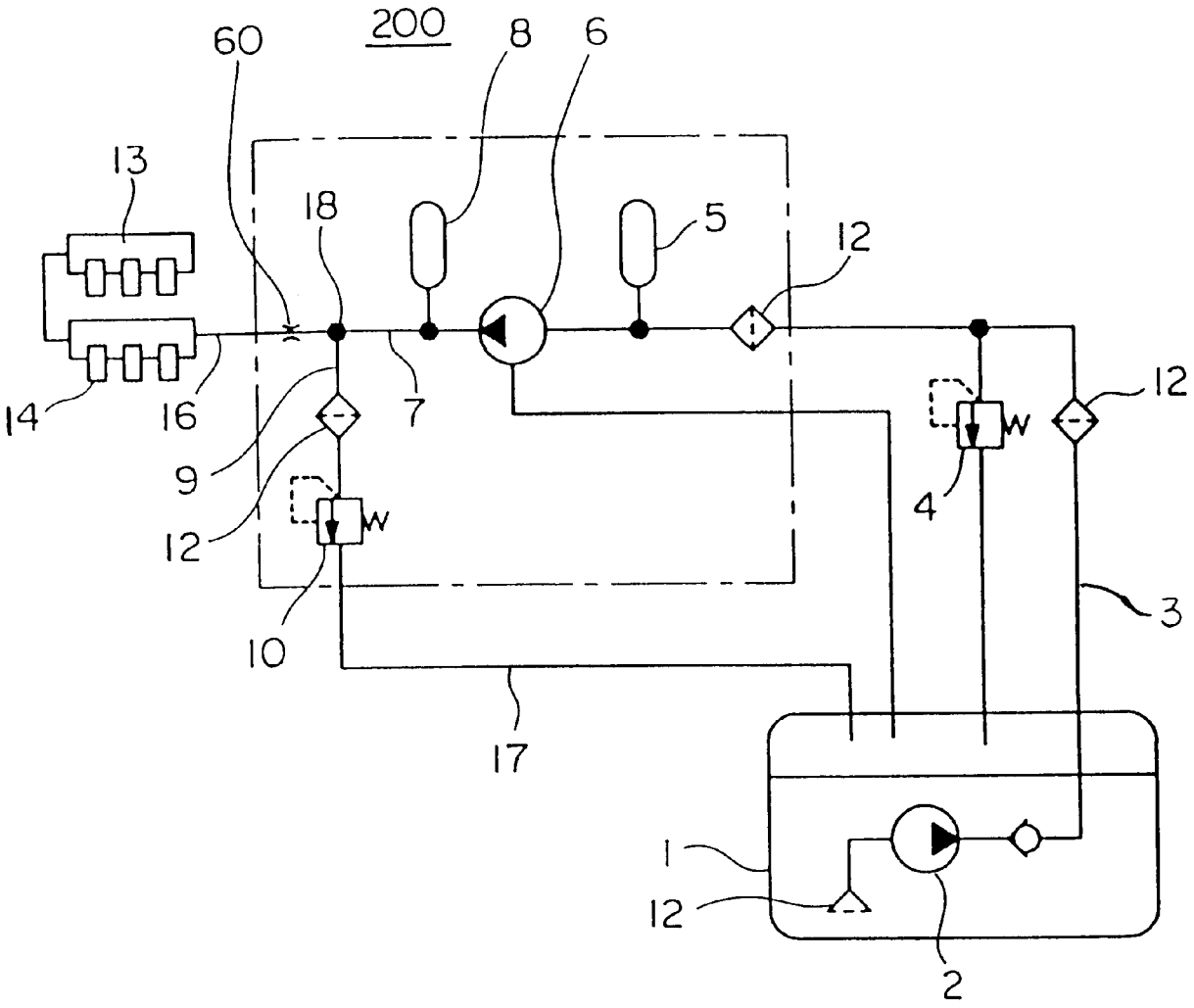
FIG. 1 is a block diagram of a high-pressure fuel supply assembly according to Embodiment 1 of the present invention.
Figure 2:
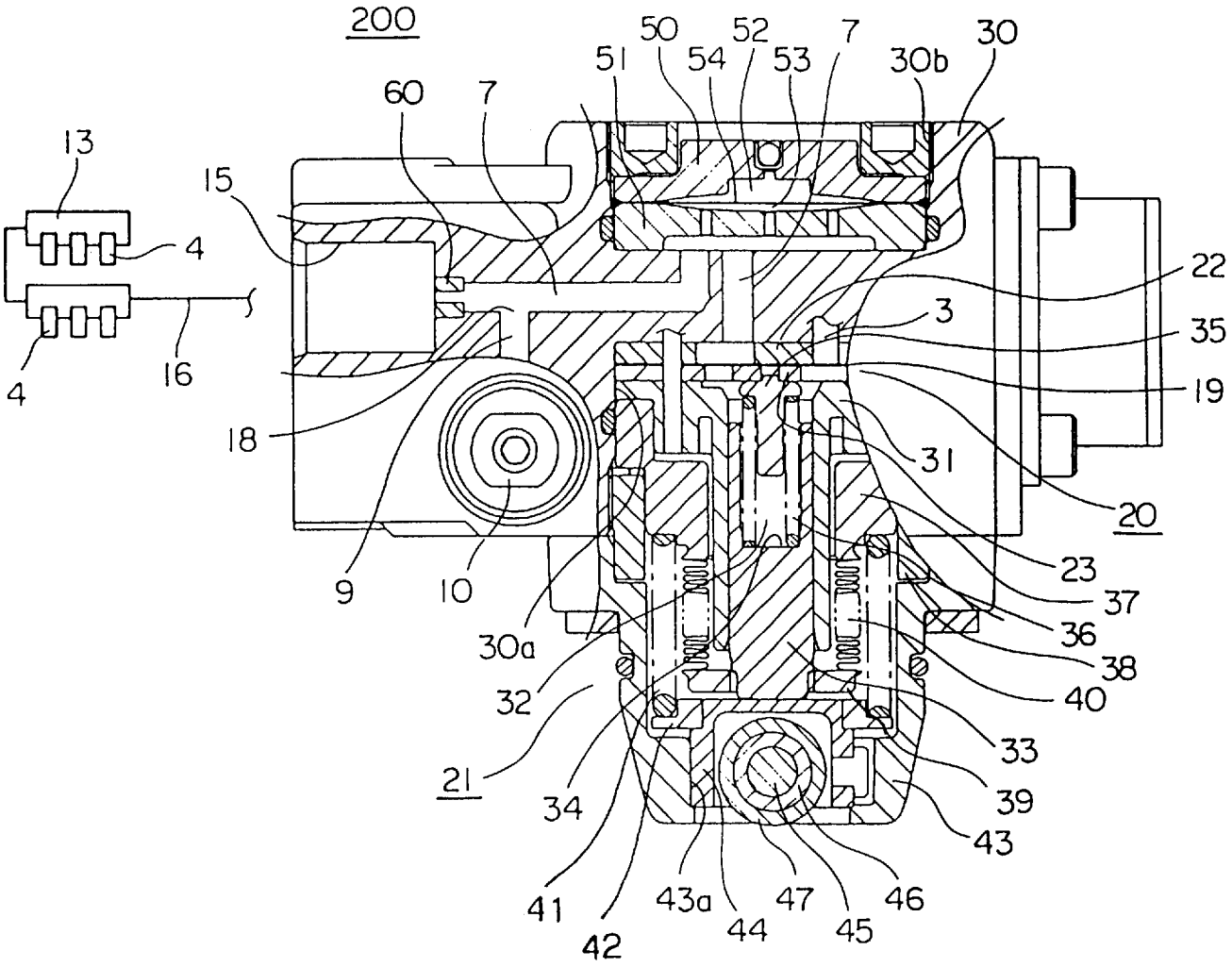
FIG. 2 is a partially cut away general cross section of the high-pressure fuel supply assembly in FIG. 1.

FIG. 1 is a block diagram showing a construction of a high-pressure fuel supply assembly 200 according to the present invention, and FIG. 2 is a partially cut away general cross section of the high-pressure fuel supply assembly 200.

This high-pressure fuel supply assembly 200 includes:

- a low-pressure regulator for pressurizing low-pressure fuel to a predetermined pressure, the low-pressure regulator being disposed in a low-pressure fuel intake passage 3 through which flows low-pressure fuel from a low-pressure fuel pump 2 within a fuel tank 1;
- a low-pressure damper 5 for absorbing surges in the low-pressure fuel, the low-pressure damper 5 being disposed in the low-pressure fuel intake passage 3;
- a high-pressure fuel pump 6 for pressurizing low-pressure fuel from the low-pressure damper 5 and discharging it into a high-pressure fuel discharge passage 7;
- a high-pressure damper 8 for absorbing surges in the high-pressure fuel flowing through the high-pressure fuel discharge passage 7;
- a high-pressure regulator 10 for adjusting the high-pressure fuel to a predetermined pressure, the high-pressure regulator 10 being disposed in a branch passage 9 branching from a branch portion 18 of the high-pressure fuel discharge passage 7; and
- an orifice 60 which is a throttle body disposed in an entrance portion of a fuel discharge port 15 in the high-pressure fuel discharge passage 7 downstream from the branch portion 18. Moreover, 12 are filters, and 17 is a drainage pipe connecting the high-pressure regulator 10 to the fuel tank 1.

The above high-pressure fuel pump 6 includes: a valve assembly 20 for opening and closing the low-pressure fuel intake passage 3 and the high-pressure fuel discharge passage 7; and a high-pressure fuel supply body 21 for pressurizing low-pressure fuel from the low-pressure fuel intake passage 3 and discharging it into the high-pressure fuel discharge passage 7.

The valve assembly 20 includes: a first plate 22; a second plate 23; and a thin, flat valve main body 19 positioned between the first and second plates 22 and 23. A first fuel inlet 24 connected to the low-pressure fuel intake passage 3 and a first fuel outlet 25 connected to the high-pressure fuel discharge passage 7 are formed in the first plate 22, the inside dimensions of the first fuel outlet 25 being larger than the inside dimensions of the first fuel inlet 24. A second fuel inlet 26 having inside dimensions larger than those of the first fuel inlet 24 and a second fuel outlet 27 having inside dimensions smaller than those of the first fuel outlet 25 are formed in the second plate 23. The valve main body 19 is provided with: an intake-side tongue 28 interposed between the first fuel inlet 24 and the second fuel inlet 26; and a discharge-side tongue 29 interposed between the first fuel outlet 25 and the second fuel outlet 27.

The high-pressure fuel supply body 21 includes:

- a casing 30 housing the valve assembly 20 inside a first recess 30*a;*
- a cylindrical sleeve 31 housed in surface contact with the second plate 23 of the valve assembly 20;
- a piston 33 slidably inserted inside the sleeve 31 forming a fuel pressurization chamber 32 in cooperation with the sleeve 31; and
- a first spring 36 disposed between a recessed bottom surface 34 of the piston 33 and a holder 35, the spring 36 applying force to the piston 33 in a direction which expands the volume of the fuel pressurization chamber 32.

The high-pressure fuel supply body 21 also includes:

- a housing 37 fitted over the sleeve 31;
- a ring-shaped securing member 38 securing the valve assembly 20, the sleeve 31, and the housing 37 inside the first recess 30*a* of the casing 30 by fitting over the housing 37 and engaging the first recess 30*a* of the casing 30 by means of a male thread portion formed on an outer circumferential surface of the securing member 38;
- a metal bellows 40 disposed between the housing 37 and a receiving portion 39;
- a second spring 41 compressed and disposed around the outside of the bellows 40 between the housing 37 and a holder 42; and
- a bracket 43 disposed to surround the second spring 41, the bracket 43 being secured to the casing 30 by a bolt (not shown).

The high-pressure fuel supply body 21 also includes:

- a tappet 44 slidably disposed in a slide bore 43*a* in an end portion of the bracket 43;
- a pin 45 rotatably suspended to follow the shape of a cam (not shown) as a cam shaft rotates and to reciprocate the piston 33; and
- a bush 46 and a cam roller 47 each rotatably fitted onto the pin 45.

The above high-pressure damper 8 is screwed into a second recess 30*b* in the casing 30. The high-pressure damper 8 includes:

- a first case 50;
- a second case 51 disposed opposite the first case 50, the second case 51 forming a space in cooperation with the first case 50; and
- a thin, flat disk-shaped stainless steel diaphragm 54 dividing the space into a back-pressure chamber 52 charged with high-pressure gas and a buffer chamber 53. The diaphragm 54 moves so that the pressure of the fuel flowing into the buffer chamber 53 from the high-pressure fuel discharge passage 7 is equalized with the pressure of the high-pressure gas in the back-pressure chamber 52, thereby changing the volume inside the buffer chamber and absorbing surges in the fuel in the high-pressure fuel discharge passage 7.

In a high-pressure fuel supply assembly 200 having the above construction, the piston 33 is reciprocated by the rotation of the cam secured to the cam shaft of an engine (not shown) by means of the cam roller 47, the bush 46, the pin 45, and the tappet 44.

When the piston 33 is descending (during the fuel intake stroke), the volume of the inside of the fuel pressurization chamber 32 increases and the pressure inside the fuel pressurization chamber 32 decreases. When the pressure inside the fuel pressurization chamber 32 falls below the pressure at the first fuel inlet 24, the intake-side tongue 28 of the valve main body 19 bends towards the second fuel inlet 26, allowing fuel in the low-pressure fuel supply passage 3 to flow through the first fuel inlet 24 into the fuel pressurization chamber 32.

When the piston 33 is ascending (during the fuel discharge stroke), the pressure inside the fuel pressurization chamber 32 increases, and when the pressure inside the fuel pressurization chamber 32 rises above the pressure at the first fuel outlet 25, the discharge-side tongue 29 of the valve main body 19 bends towards the first fuel outlet 25, allowing fuel in the fuel pressurization chamber 32 to flow through the first fuel outlet 25 and the high-pressure fuel discharge passage 7 into the high-pressure damper 8, where fuel pressure surges are absorbed. Fuel pressure surges in the high-pressure fuel are additionally absorbed by the orifice 60 which is disposed in an entrance portion of the fuel discharge port 15. After surges have been removed, the high-pressure fuel is supplied to a delivery pipe 13 via the fuel discharge port 15 and a high-pressure pipe 16, and thereafter supplied to each of the cylinders (not shown) of the engine via the fuel injection valves 14.

In the high-pressure fuel supply assembly 200 in Embodiment 1 above, the internal pressure of the high-pressure fuel supply assembly 200 is determined by the high-pressure regulator 10 which is disposed in the branch passage 9 which branches from the branch portion of the 18 of the high-pressure fuel discharge passage 7 and is not affected by the orifice 60 which is disposed in an end portion of the high-pressure fuel discharge passage 7.

Figure 3:
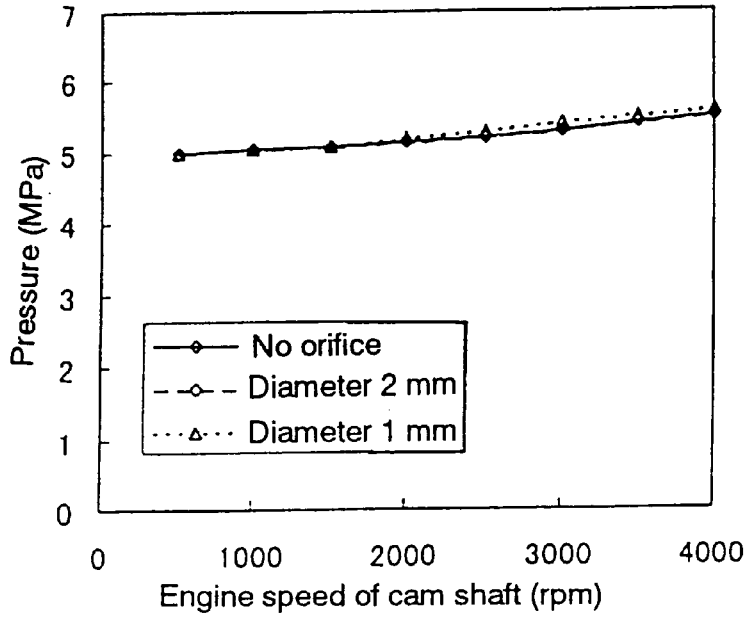
FIG. 3 is a graph of the relationship between the rotational frequency of the cam shaft and internal pressure in the high-pressure fuel supply assembly in FIG. 1.

FIG. 3 shows data obtained experimentally by the present inventors for the effects of the presence and absence of the orifice 60 on internal pressure in the high-pressure fuel supply assembly 200. It can be seen that the presence or absence of the orifice 60 had substantially no effect and that any rise in pressure was low in the high-pressure fuel supply assembly 200 even when the orifice 60 was present.

Figure 4:
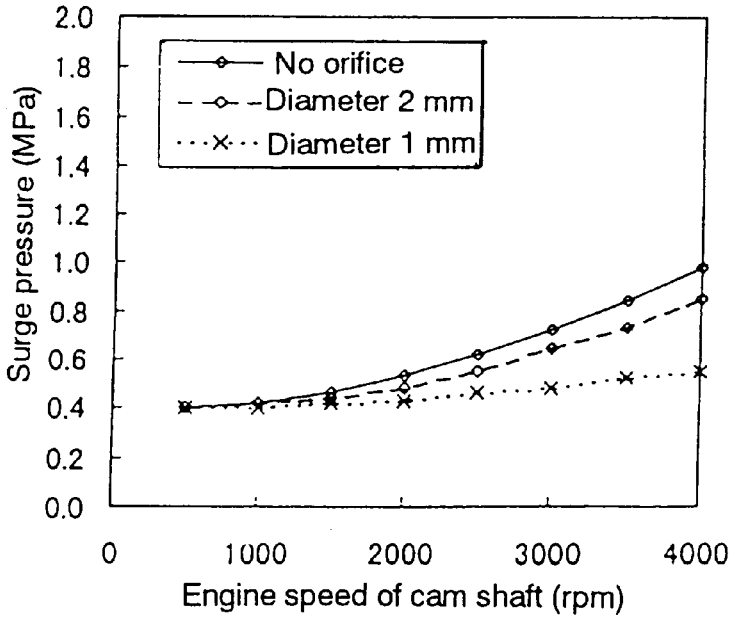
FIG. 4 is a graph of the relationship between the rotational frequency of the cam shaft and surge pressure in the delivery pipe in the high-pressure fuel supply assembly in FIG. 1.
Figure 10:
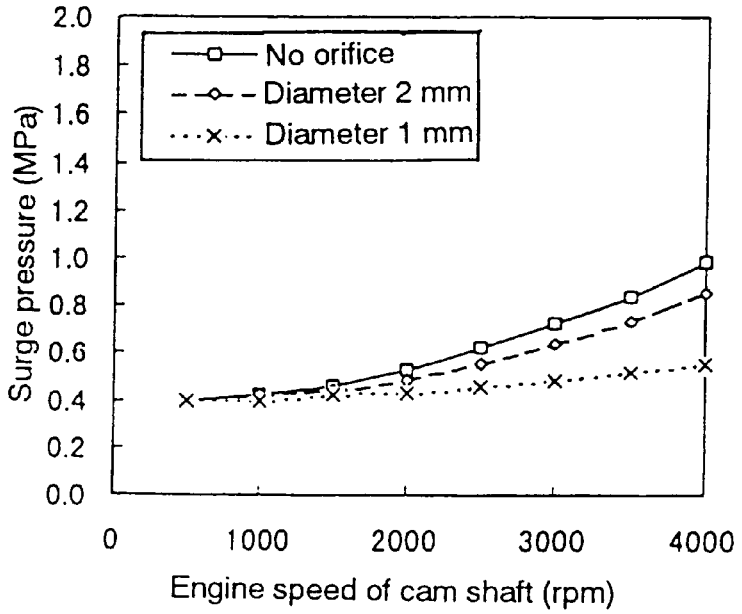
FIG. 10 is a graph of the relationship between the rotational frequency of the cam shaft and surge pressure in the delivery pipe in the high-pressure fuel supply assembly in FIG. 6.

On the other hand, as can be seen from FIG. 4, surge pressure in the delivery pipe was smaller when the orifice 60 was provided than when there was no orifice 60, and the smaller the diameter of the bore of the orifice 60, the lower the surge pressure in the delivery pipe 13 was, showing that the surge pressure reducing effects of the orifice 60 are similar to those of the conventional example (see FIG. 10). Furthermore, when the diameter of the bore of the orifice 60 was 1 mm, the internal pressure of the high-pressure fuel supply assembly 200 was substantially the same as for 2 mm, but when the rotational frequency of the cam shaft was 4000 rpm, the surge pressure was 0.84 MPa for 2 mm whereas it was 0.55 MPa for 1 mm, indicating a significant reduction in surge pressure.

Embodiment 2

Figure 5:
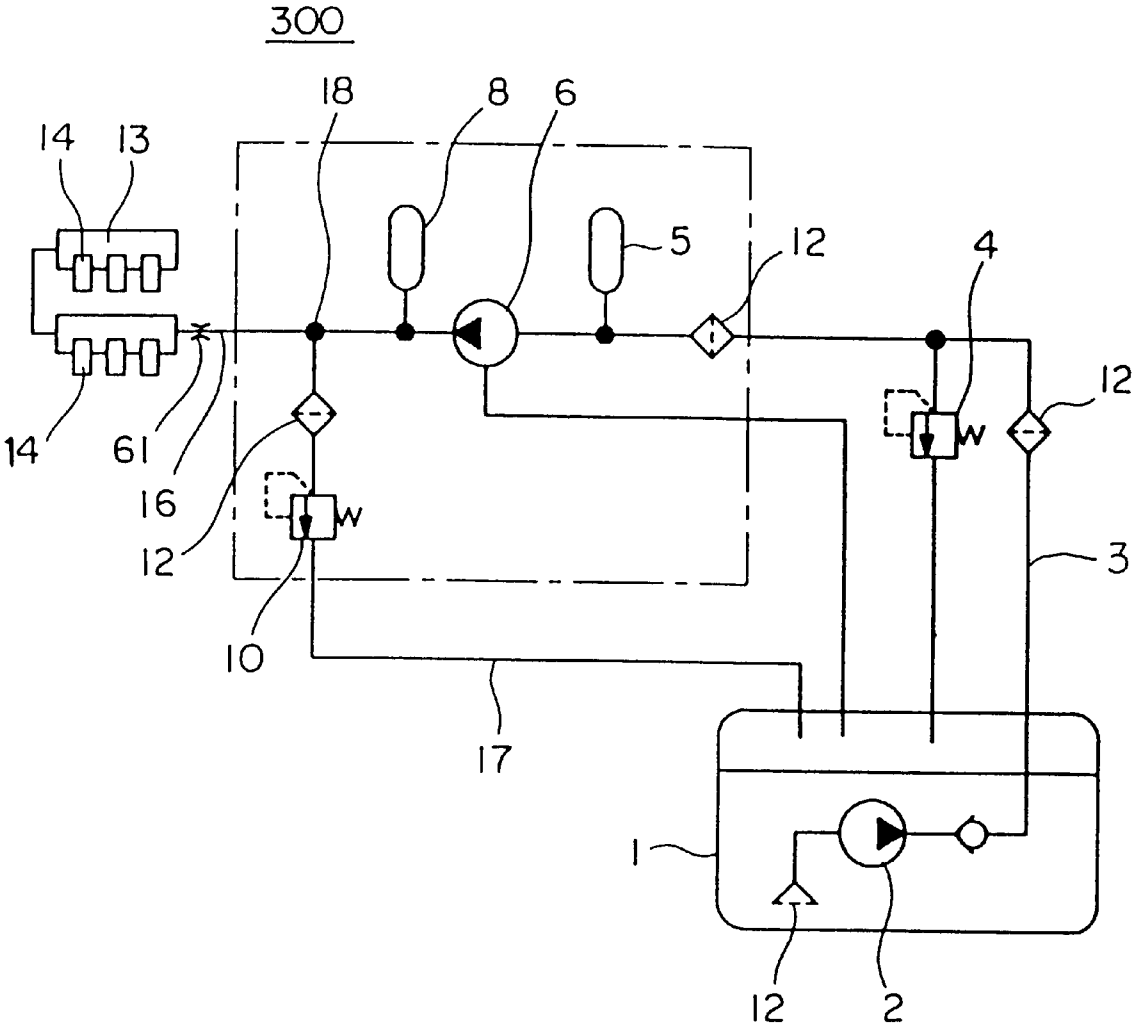
FIG. 5 is a block diagram of a high-pressure fuel supply assembly according to Embodiment 2 of the present invention.

FIG. 5 is a block diagram showing a construction of a high-pressure fuel supply assembly 300 according to Embodiment 2 of the present invention. In Embodiment 2, an orifice 61 which is a throttle body is disposed in the high-pressure pipe 16 connected to the fuel discharge port 15 at one end and to a delivery pipe 13 at the other end.

The rest of the construction is the same as for Embodiment 1 and explanation thereof will be omitted.

In Embodiment 2, in addition to achieving the same effects as in Embodiment 1, modifications to the specifications of the orifice can be carried out by a simple replacement operation involving the mounting of the modified orifice in the high-pressure pipe.

Moreover, in Embodiments 1 and 2 above, a throttle body was used as an example of an orifice, but the orifice is not limited thereto, and may also be a nozzle, for example.

As explained above, a high-pressure fuel supply assembly according to one aspect of the present invention comprises: the throttle body for absorbing surges in the high-pressure fuel, the throttle body being disposed in the high-pressure fuel discharge passage downstream from the branch portion. Therefore, the internal pressure of the high-pressure fuel supply assembly is determined by the high-pressure regulator, enabling improvements in the durability of the high-pressure fuel pump and the cam shaft and reductions in the working pressure range of the high-pressure damper without increasing the internal pressure of the high-pressure fuel supply assembly due to pressure losses.

A high-pressure fuel supply assembly according to another aspect of the present invention comprises a throttle body for absorbing surges in the high-pressure fuel from the high-pressure fuel discharge passage, the throttle body being disposed in the high-pressure pipe. Therefore, in addition to the effects of above one aspect of the present invention, the replacement operation for the throttle body is simplified.

According to one form of the high-pressure fuel supply assembly, the throttle body may be an orifice. Therefore, surges can be absorbed inexpensively by a simple construction.

According to another form of the high-pressure fuel supply assembly, the surge pressure in the delivery pipe is significantly reduced when the diameter of the bore of the orifice is 1 mm.

What is claimed is:

1. A high-pressure fuel supply assembly comprising:

a high-pressure fuel pump for pressurizing fuel from a low-pressure fuel intake passage and discharging it into a high-pressure fuel discharge passage;

a high-pressure damper for absorbing surges in said high-pressure fuel, said high-pressure damper being disposed in said high-pressure fuel discharge passage downstream from said high-pressure fuel pump;

a high-pressure regulator for adjusting high-pressure fuel from said high-pressure damper to a predetermined pressure, said high-pressure regulator being disposed in a branch passage branching from a branch portion of said high-pressure fuel discharge passage downstream from said high-pressure damper; and a throttle body for absorbing surges in said high-pressure fuel, said throttle body being disposed in said high-pressure fuel discharge passage downstream from said branch portion.

2. A high-pressure fuel supply assembly comprising:

a high-pressure fuel pump for pressurizing fuel from a low-pressure fuel intake passage and discharging it into a high-pressure fuel discharge passage;

a high-pressure damper for absorbing surges in said high-pressure fuel, said high-pressure damper being disposed in said high-pressure fuel discharge passage downstream from said high-pressure fuel pump;

a high-pressure regulator for adjusting high-pressure fuel from said high-pressure damper to a predetermined pressure, said high-pressure regulator being disposed in a branch passage branching from a branch portion of said high-pressure fuel discharge passage downstream from said high-pressure damper;

a high-pressure pipe having a first end portion connected to said high-pressure fuel discharge passage and a second end portion connected to a delivery pipe mounted with fuel injection valves; and a throttle body for absorbing surges in said high-pressure fuel from said high-pressure fuel discharge passage, said throttle body being disposed in said high-pressure pipe.

3. The high-pressure fuel supply assembly according to claim 1 wherein said throttle body is an orifice.

4. The high-pressure fuel supply assembly according to claim 1 wherein a diameter of a bore of said orifice is 1 mm.

* * * * *